United States Patent [19]

Cornwell, Jr.

[11] 4,247,039

[45] Jan. 27, 1981

[54] MAILBOX SIGNAL AND DOOR HANDLE DEVICE

[75] Inventor: Alexander M. Cornwell, Jr., St. Louis, Mo.

[73] Assignee: Jackes-Evans Manufacturing Company, St. Louis, Mo.

[21] Appl. No.: 954,335

[22] Filed: Oct. 25, 1978

Related U.S. Application Data

[60] Division of Ser. No. 812,373, Jul. 1, 1977, Pat. No. 4,148,432, which is a continuation-in-part of Ser. No. 664,538, Mar. 8, 1976, abandoned.

[51] Int. Cl.[3] ..... D65D 91/00

[52] U.S. Cl. ..... 232/35; 232/45

[58] Field of Search ..... 232/35, 34, 17, 45, 232/44; 312/320

[56] References Cited

U.S. PATENT DOCUMENTS

| | | | |
|---|---|---|---|
| 1,304,700 | 5/1919 | Otte | 312/320 |
| 1,451,876 | 4/1923 | Jewett, Jr. | 232/35 |
| 2,315,925 | 4/1943 | Bescherer | 312/320 |
| 2,431,838 | 12/1947 | Staley | 232/17 |
| 2,856,123 | 10/1958 | Mary | 232/35 |
| 3,017,073 | 1/1962 | Piergiovanni | 232/35 |
| 3,709,189 | 1/1973 | Widham | 232/35 X |

*Primary Examiner*—Roy D. Frazier
*Assistant Examiner*—Peter A. Aschenbrenner
*Attorney, Agent, or Firm*—Kirkland & Ellis

[57] ABSTRACT

A mail box gang apparatus which utilizes the construction of a mail box as an inherent structural component of the gang to achieve uniformity in mail box appearance, greater strength and permanency. The apparatus may include two horizontal rows of mail boxes mounted one upon the other, the boxes being affixed to one another at both the upper and lower portions to form an integral beam type structure of substantial strength. To facilitate such ganging in the manner described, the mail boxes are modified to include a new flagging system which advises the mail man of the presence of outgoing mail. This flag system affixed to the door of the box includes a panel which is merely rotated to disclosed a flag indication and is automatically reset upon opening of the box. In the preferred embodiment, the mail box door is modified to facilitate mounting of the flag and includes a novel latch device together with a pleasing appearance.

6 Claims, 20 Drawing Figures

MAILBOX SIGNAL AND DOOR HANDLE DEVICE

CROSS-REFERENCE

This is a division of application Ser. No. 812,373, filed July 1, 1977, now U.S. Pat. No. 4,148,432, which is a continuation-in-part of U.S. Application, Ser. No. 664,538 filed March 8, 1976, now abandoned.

BACKGROUND OF THE INVENTION

This invention relates to mail box ganging apparatus. More particularly, it relates to a system and apparatus for assembling a gang of mail boxes together with modification of boxes to facilitate such ganging.

While the shape and construction of rural mail boxes have generally been standardized along one or more sets of specifications approved by the Post Master General, their installation and support structures have taken various forms with little regard to the strength, permanency, aesthetics and facilitation of delivery of mail by mail men. To facilitate and expedite delivery, the ganging of a plurality of mail boxes at one location is most desired. Such ganging, when implemented, has required horizontal and vertical supporting platforms for each box of the gang and such supporting platforms for each box of the gang and such supporting platforms involve cost and construction problems whose solution heretofore have neither been uniform, simple nor of low cost. Moreover, the present construction of mail boxes utilizes indicator flags to communicate to mail men that the box contains outgoing mail. This flag construction is believed to be relatively expensive in fabrication and fails to lend itself to the ganging of mail boxes at the lowest cost. Moreover, the present latching mechanism requires separate stamping of piece parts which, when mounted, extend outwardly beyond the body of the box to facilitate their destruction or deformation.

To expedite delivery of mail and to minimize the cost of mail box construction, a desirable mail box and ganging apparatus would include:

(a) a unit which would eliminate vertical and horizontal supporting platforms;

(b) a unit which would utilize the construction of the mail box as an inherent structural component;

(c) an apparatus in which multiple rows of boxes can be ganged in a manner to achieve greater strength and permanency at the lowest possible cost;

(d) an apparatus in which the multiple rows of boxes could be ganged to inherently form a construction similar in effect to that of a rigid wide flange beam;

(e) a box flag system low in cost, simple in manufacture and which would not interfere with proper ganging of the mail boxes adjacent to one another; and (f) an access door which facilitates the mounting of the flag system and simplifies the latching mechanism.

SUMMARY OF THE INVENTION

In order to achieve one or more of the desirable features of a ganged mail box apparatus, the instant invention includes at least one horizontal row of mail boxes positioned adjacent to one another and interconnected at their upper and lower portions to inherently constitute a beam type assembly. When so connected, the row of boxes, comprising a beam, eliminate the use of horizontal support platforms. Moreover, another preferred form of the invention includes at least two rows of mail boxes positioned one upon the oher and interconnected so as to provide further strength to the mail box gang.

In adjoining boxes one to another, the invention also includes a new flag system to indicate the presence of outgoing mail to the mailman, this flag system including an indicator mounted on the door of a box and adapted to be moved to its flagging position by simple rotational motion. Moreover, the indicator is so designed that upon opening of the door, the flag repositions itself to the unflagged position. Finally, the invention includes a door specially adapted for mounting the flag and for simplifying the door latch mechanism.

Accordingly, it is an object of the instant invention to provide a ganged mail box apparatus which includes one or more of the desirable characteristics previously mentioned. An important object of the instant invention is to provide apparatus for facilitating the ganging of existing mail boxes. Another object of the instant invention is to provide a novel flagging system to indicate the presence of outgoing mail which can be manufactured more simply than heretofore known, and which simultaneously facilitates the ganging of mail boxes. Further, this flagging system may be easily incorporated into a novel access door having a simplified latch mechanism.

DESCRIPTION OF THE DRAWINGS

The manner in which these and other objects of the instant invention are attained will be made clear with reference to the following specification and drawings, in which.

DETAILED DESCRIPTION

Figure 1:
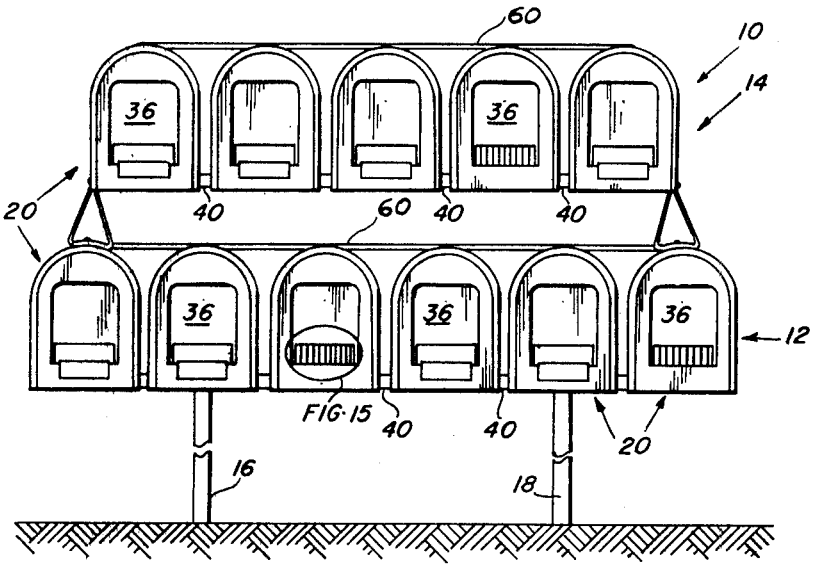
FIG. 1 is an elevational view of a preferred embodiment of my invention.

The ganged mail box apparatus 10 of my invention depicted in FIG. 1 includes a bottom row of mail boxes 12 vertically supporting a top row of ganged mail boxes 14, the combination being mounted on two vertical standards 16 and 18. As shown, this ganged assembly 10 does not include any horizontal platforms for separately mounting each row of boxes, nor is there a vertical support means underneath each box. Instead, the individual boxes 20 are connected one to another in a manner analagous to that of an elongated horizontal beam which, by virtue of the substantial vertical separation between the top and bottom of each box, permits these two elements to act as flanges of a wide flanged beam resulting in substantial resistance to deflection.

Figure 2:
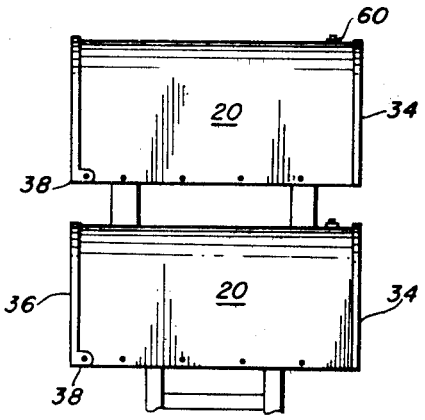
FIG. 2 is a side elevational view of FIG. 1.
Figure 3:
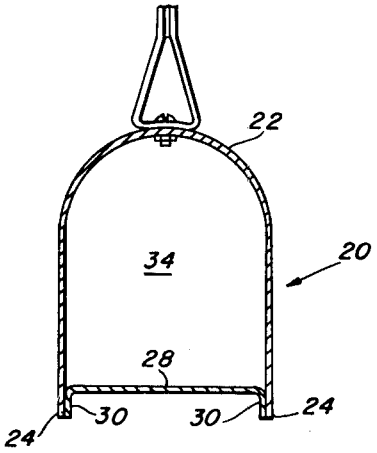
FIG. 3 is an elevational view of a single mail box of FIG. 1.

The manner in which this beam-like structure is formed can best be understood in reference to FIG. 3 which depicts an individual mail box 20, and FIGS. 4 through 11. The mail box of FIG. 3 generally comprises an inverted U-shaped casing 22 having two downward depending elongated edges 24—24. Conventionally, the open portion of the U-shaped casing is closed by flat bottom 18 which also has two downwardly depending edges 30—30 placed in juxtaposition with the edged 24—24 and bolted or welded in place to form a tubular casing as depicted. The rear end of this casing is closed by back panel 34, while on the front is mounted a door 36 pivotally mounted about a horizontal axis 38 by pivot connections as shown in FIG. 2.

Figure 4:
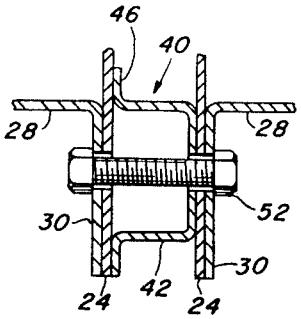
FIG. 4 is a preferred embodiment of the spacer apparatus of affixing the lower edges of the mail boxes one to another.
Figure 5:
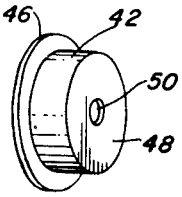
FIG. 5 is a perspective view of the spacer apparatus of FIG. 4.

To assemble each of these boxes 20 into the horizontal row 12 or 14 of FIG. 1, the preferred embodiment of my invention utilizes coupling means 40 to interconnect the lower edge of each box, and elongated bar members 60 to interconnect the top of each of these boxes. Preferably, as shown in FIGS. 4 and 5, the coupling means 40 comprises a pressed tubular member 42 formed from sheet stock and having an annular flange 46 at one end. Through the opposite end 48 passes an aperture 50. During assembly, this spacer member 42 is positioned between the lower edges 24—24 of two adjoining mail boxes. Subsequently, a bolt or rivet 52 is then passed through apertures formed in lower edges 24 of the casing, the tubular spacer 42, and the flanges 30 of bottom member 28 as shown. Preferably, at least two of these spacers 42 are provided along the bottom edges of each of the adjoining mail boxes. The coupling means as depicted in FIGS. 4 and 5 is preferred when existing mail boxes are to be coupled together, the coupling means 40 and the remaining connecting elements of this invention being sold as an assembly kit.

Figure 6:
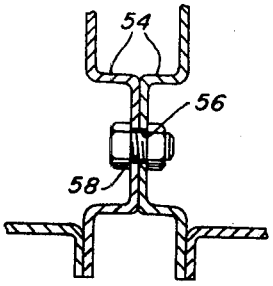
FIG. 6 discloses a front elevational view of another preferred embodiment of the spacer apparatus of my invention.
Figure 7:
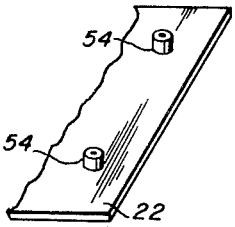
FIG. 7 depicts a perspective view of a mail box utilizing the spacer of FIG. 6.

However, one method of reducing assembly cost is depicted in FIGS. 6 and 7 in which the casing 22, still in its flat sheet state, is placed into a press and bosses 54 having an aperture 56 therein are press formed into the flat sheet. Subsequently, upon bending of the flat sheet into the tubular casing form 22, the lower portion of each mail box will have a boss extending outwardly at transversely disposed positions along the lower edge of the box as shown in FIG. 7. With this construction, no separate spacing means 42 is required, the boxes being placed adjacent one to another with a bolt 56 being passed therethrough and tightened to interlock the lower portions of the box. Obviously such projections may be placed above the lower flange of the boxes as shown in FIG. 6, or they may be formed in both the depending flanges 32 of the bottom number 32, and the bottom edges 24 of the mail box.

Figure 9:
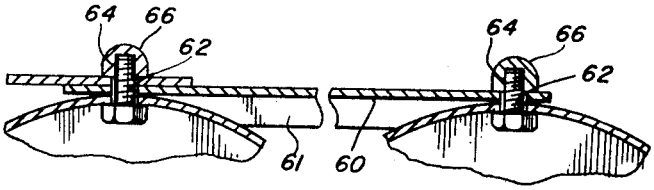
FIG. 9 discloses an elevational view of a preferred means of interconnecting the tops of the boxes one to another.

A preferred method of interconnecting the tops of the boxes is depicted in FIG. 9 which includes an elongated bar member 60 having apertures 62 at each end. These bars may be flat or of an inverted U-shape, in which case the downward extending flanges 61 of the bar are contoured to the shape of the top of the mail boxes. The apertures 62 are positioned such that a bolt 64 may extend upwardly therethrough from the interior of casing 22 so as to lock each of the boxes 20 in fixed position relative to one another. Preferably, a hemispherical nut 66 is used to lock bolt 64 in place. As shown in FIG. 9, a plurality of boxes may be joined using individual segments to interconnect each box. Alternatively, when the number of boxes to be incorporated into a gang is known, one elongated bar having a plurality of apertures therein appropriately positioned may be utilized to interconnect the tops of each box. Depending upon the strength desired, two separate rows of bars 60 may interconnect the casing members 22 at both their forward and rearward ends. Alternatively, one bar member 60 interconnecting two boxes has been found to be sufficient.

Figure 8:
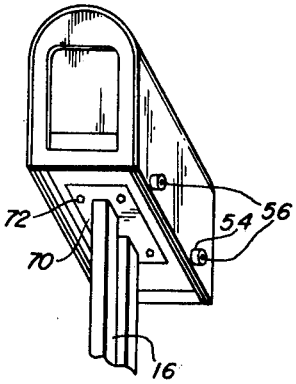
FIG. 8 depicts a perspective view of the vertical support members for the gang of mail boxes of FIG. 1.

When a group of boxes is assembled into a row using the interconnection means previously described, such a row of boxes can be mounted upon vertical standards 16 or 18 in the manner depicted in FIG. 8. The disclosed standard 16 is provided with a horizontal flange 70 having four apertures therein for mating with apertures in a selected one of the mail boxes. Then, bolts 72 are extended through the bottom 28 of the mail boxes and through the apertures in this horizontal flange 70 to lock each row of boxes to these vertical standards 16 and 18. When so assembled, the row of mail boxes comprises a fixed solid beam supported by two vertical standards, such having substantial strength, durability and aesthetic appearance.

Figure 10:
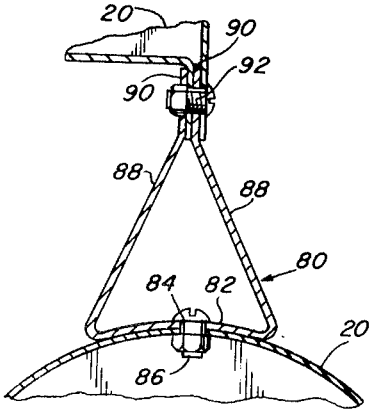
FIG. 10 is an elevational view depicting a preferred bracket for mounting one row of boxes upon another row of boxes.
Figure 11:
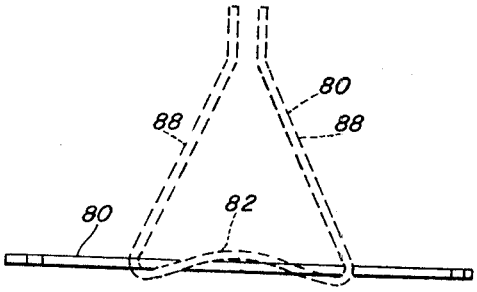
FIG. 11 is an elevational view depicting a preferred method of forming the bracket of FIG. 10.

When desired, additional mail boxes may be placed in the gang by either extending the number of boxes in each row, or by vertically positioning a second row 14 on top of the bottom row 12 as depicted in FIG. 1. A preferred method of mounting one row upon the other is shown in FIG. 1 in which triangular bracket 80 provides not only vertical stability but also has the capacity to resist horizontal forces applied to the top row as well. Preferably, this bracket 80 has a curved base 82 with an aperture 84 extending through the central portion thereof for receiving a bolt 86 connecting the bracket to the top of selected lower boxes 20. If desired, the base portion of the bracket may take the contour of the top of the box 20. Extending upwardly from the base 82 are two sides of a preferably isosceles triangle 88,88 which terminate in upwardly extending flanges 90. As shown in FIG. 10, these flanges 90 and the lower edges of the mail box have an aperture through which extends a bolt 92 locking the bracket 80 to the lower edges of the box 20. By using the triangular configuration shown in FIG. 10, each of the side legs 88,88 will have a horizontal component which resists lateral movement of the top row of boxes relative to the lower row. Preferably, this bracket is formed of straight, flat sheet strip formed by die presses into the dotted line shape depicted in FIG. 11.

Figure 12:
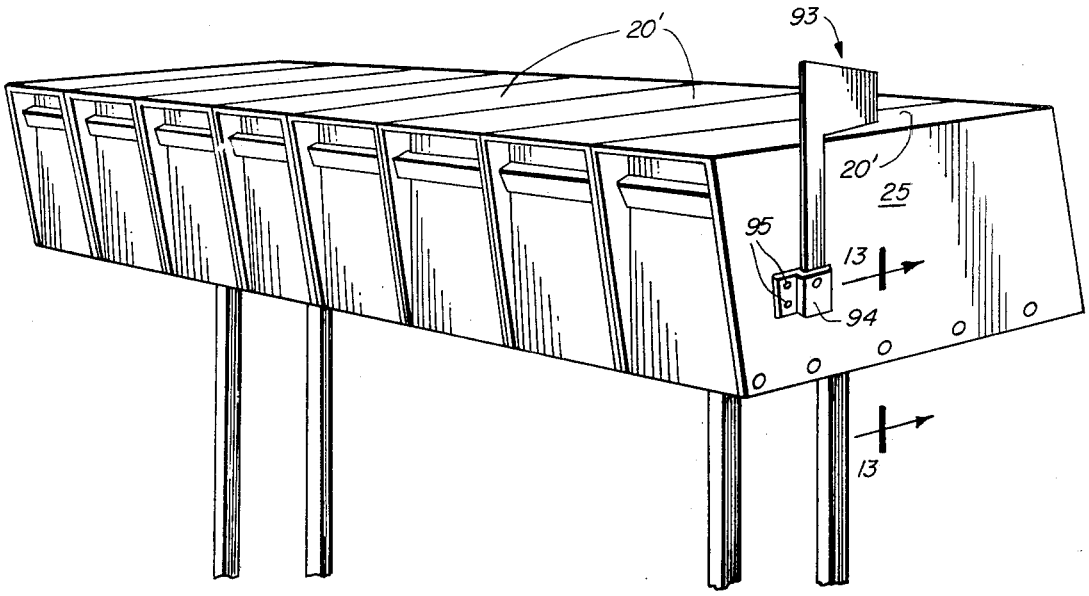
FIG. 12 is a perspective view disclosing another embodiment of my invention.
Figure 13:
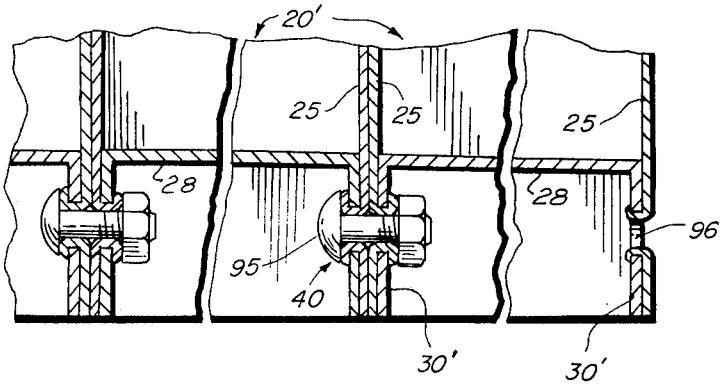
FIG. 13 is a front, elevational view taken along the lines 13—13 of FIG. 12.

Another embodiment of my ganged mail box is depicted in FIGS. 12 and 13. The individual boxes 20 of this embodiment have a rectangular cross section whose vertical side walls rest against one another when ganged as shown in FIG. 13.

Each box 20 may be sold separately and is provided with a generally standard flag unit 93. This flag unit is provided with an L-shaped bracket 94 affixed to the box by two bolts 95 passing through apertures in one of the side walls.

As shown in FIG. 13, the lower edges 24 of these boxes are provided a plurality of apertures 96. In the lower flanges 30' of the bottom 28, these apertures are merely punched out. However, the apertures of the bottom 24 edges of side walls 25 are extruded or drawn inward. The extruded material is then riveted against the inner side of flange 30'. Such permits joinder of the side walls 25 and bottoms 28 without bolts or other protrusions extending transversely of the side wall 25. In addition, this method of joinder permits ganging of the boxes 20 without space between the boxes.

These boxes may be sold separately. When ganging is desired, the interior flag units 93 are removed. The bolts 95 are then extended through two of the extruded apertures 96 to join the bottom edges of the boxes together and to define the coupling means 40. When interconnected in this manner, the side walls 25 of each rest against one another, and each acts as a web of a beam having as flanges the top and bottom of each box. Such forms an inherent beam-like structure. If desired, the upper portions of the boxes may be interconnected to further rigidify the beam against upward bending deflections.

Figure 14:
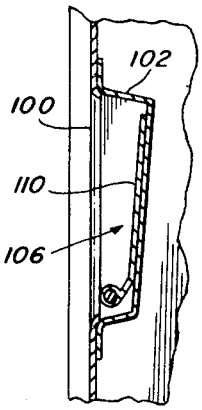
FIG. 14 is a side elevational view in section of a preferred embodiment of my indicator apparatus in its flagging position.

The use of the structure depicted or explained thus far permits a coupling of the boxes one to another in close adjoining relationship and the vertical stacking of boxes one upon another. When so assembled, the ganged adjoining boxes do not lend themselves to the use of the conventional pivotal flag often mounted on the side of each box 20. In accord with my invention, a novel flag may be used which permits incorporation thereof into the front door of the mail box. As shown in FIG. 14, such involves the stamping of an aperture 100 into the front door of the mail box, and the placement of a recessed cavity plate 102 on the rear side of the door. This cavity plate should completely seal the aperture 100.

Figure 15:
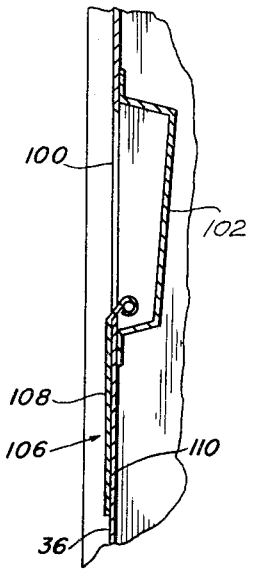
FIG. 15 is a view similar to that of FIG. 14 showing the indicator apparatus in its non-flagging position.
Figure 16:
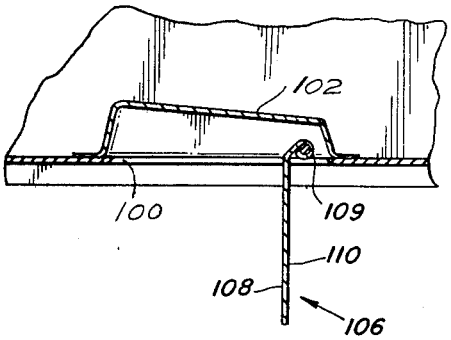
FIG. 16 is a side elevational view in section depicting the indicator apparatus of my invention with the door of the mail box in its open position.
Figure 17:
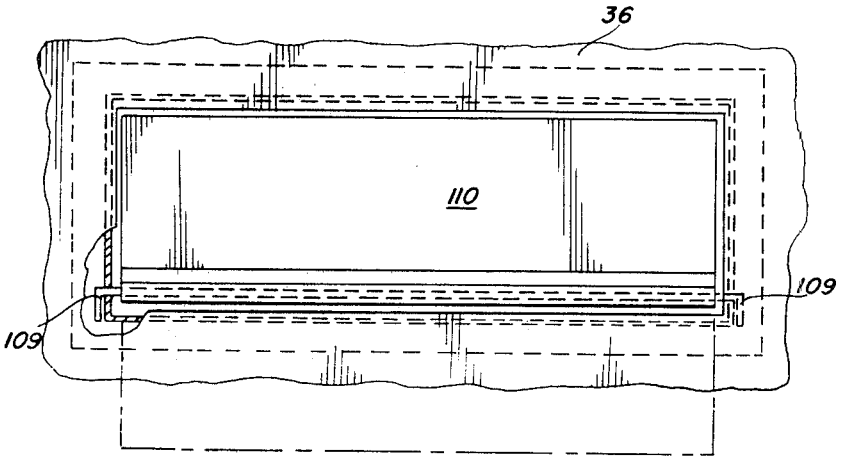
FIG. 17 is an elevational view of my indicator apparatus

This aperture and the cavity plate, which is normally exposed, should be large enough to receive a pivotal flap 106 mounted by wire protrusions 109 mounted thereon and extending into the opposite sides of cavity plate 102. One side 108 of flag plate 106 has the same appearance as box 20 and normally depends downward, parallel to and in contact with door 16 as shown in FIG. 15. The other side 110 has a contrasting appearance such as that of reflectors or a contrasting painted surface. When outgoing mail is placed in the box, the user merely rotates the flap upward through the recess 100 to an overcenter position as shown in FIG. 14. Subsequently, upon opening the door to pick up the mail, the plate 106 falls under the force of gravity to its non-flagging position.

Figure 18:
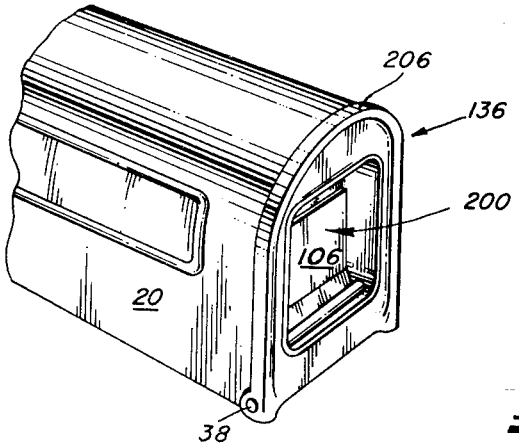
FIG. 18 is a perspective view of a preferred embodiment of an access door incorporating the flagging system.
Figure 19:
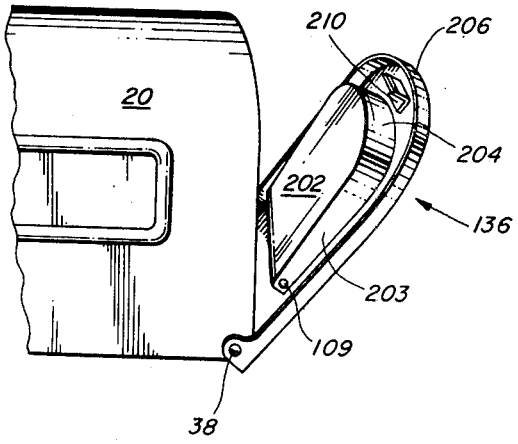
FIG. 19 is a perspective view of the door of FIG. 16 as viewed from the rear.
Figure 20:
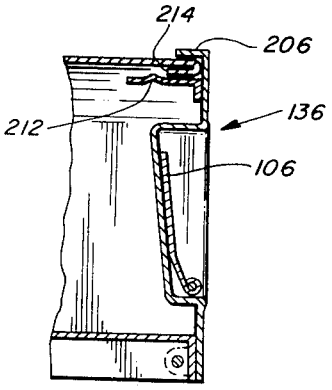
FIG. 20 is a side elevational view of the door and box of FIG. 18 taken along its vertical center line.

The cavity plate 102 need not be a separate element, but could merely be a recess stamped into the door of the mail box. A preferred access door is depicted in FIGS. 18 through 20. This door 136, pivotally mounted to the front of the box at 38, has a large recess or indentation 200 formed therein. This recess is preferably press-formed from door plate 136 to define a wall 202 inclined inwardly of the box, the wall being joined to door 136 by a continuous flange or side walls 203 which seals the interior of the box upon closing of the door.

As with FIGS. 14 through 17, the flag 106 is mounted by protrusions 109 extending into the lower end of the vertical portion of flange 203. Since wall 202 is inclined inwardly, the flag 106 can be rotated to an overcenter position against this wall to indicate the presence of outgoing mail.

Preferably, the recess 200 is sufficiently deep that the upper horizontal portion 204 of the flange 203 acts as a grasping surface which, in conjunction with the flange 206 on top of the door 136 defines a handle for grasping the door for opening.

Mounted on top of the horizontal extension 204 is an L-shaped latch member 210 which has a protrusion 212 on its upper surface. This protrusion, upon closing of the door, engages a lip 214 formed on the front portion of the box 20 by rolling its edge. Such an interior latch eliminates the stamped piece parts conventionally mounted on the exterior of the box in a forwardly extending manner.

My invention is capable of various modifications. For example, the recess 200 of the door 136 may take various configurations. Too, the coupling means 40 for the ganging may be stamped or formed of separate tubular members of a cylindrical or other shape while the interconnecting bar members 60 may have various cross sectional shapes. With reference to FIGS. 18–20, it should be noted that the latch 212, being internal of the box 20, reduces the size of the shipping carton as compared with conventional latches which extend outwardly of the box and which are exposed for possible breakage.

I claim:

1. In a mail box defined by a hollow container, a flag apparatus for indicating the presence of outgoing mail, said apparatus comprising:

an access door mounted on said container for pivotal movement about a horizontal axis;

a recess formed in said door and extending inwardly of said container, said recess being defined by a generally vertical wall affixed to said door by extending sidewalls; and a flagging plate pivotally mounted in said recess for pivotal movement between a first, generally vertical, depending position parallel to the door and a second, generally vertical, upstanding position within said recess, said flagging plate being provided with projections which extend into said sidewalls for pivotal mounting, said mounting being transversely disposed from said vertical wall for permitting said flagging plate to be rested against said vertical wall in its upstanding position.

2. An apparatus as recited in claim 1 in which said recess is press formed from said door.

3. An apparatus as recited in claim 1 in which said recess is defined by a generally vertical wall and a horizontal extension which, in conjunction with the edge of said door, defines a grasping handle.

4. In a mail box having an elongated casing for receiving mail, an improved door comprising:

a pivotal plate door mounted at one end of the casing;

a press formed recess in said door extending inwardly of said door and defining a flat generally vertical wall inclined inwardly of said box, said wall being connected to said door by generally horizontal connecting sidewalls, one of said sidewalls being adjacent the top of the door so as to define, in conjunction with the top, a grasping handle for opening said door; and an indicator flag mounted in said recess for pivotal movement about a horizontal axis.

5. An apparatus as recited in claim 4 in which said flag comprises:

a flagging plate pivotally mounted adjacent the bottom of said recess, said plate being adapted for pivotal movement between a depending position exposing a first side of said plate and a generally vertical, upstanding position within said recess exposing the second side of said plate, said plate being supported in the generally vertical upstanding position by the flat, generally vertical wall defined by said recess when the door is closed.

6. In a mail box having an elongated tubular casing for receiving mail, an improved door comprising:

a door mounted at one end of the casing, said door being pivotal about a horizontal axis;

a recess in said door, said recess extending inwardly of said door and defining a generally flat vertical wall inclined inwardly of the casing and connected to said door by connecting sidewalls, the horizontal, upper surface of said recess being adjacent the top of said door to thereby define, in conjunction with the top, a grasping handle for opening said door; and an indicator flag mounted in said recess, said flag being pivotal about a horizontal axis from a first position to a second position when said door is opened, thereby indicating the presence of mail within the mail box.

* * * * *

UNITED STATES PATENT AND TRADEMARK OFFICE

CERTIFICATE OF CORRECTION

PATENT NO. : 4,247,039

DATED : January 27, 1981

INVENTOR(S) : Alexander M. Cornwell, Jr.

It is certified that error appears in the above-identified patent and that said Letters Patent are hereby corrected as shown below:

Column 1, line 67, "oher" should read --other--.

Column 2, lines 67-68, "apparatus" should read --apparatus;--.

Column 5, line 56, "16" should read --36--.

Signed and Sealed this

*Twelfth* Day of *May 1981*

[SEAL]

*Attest:*

RENE D. TEGTMEYER

*Attesting Officer* *Acting Commissioner of Patents and Trademarks*